US005815949A

United States Patent [19]

Sessa

[11] Patent Number: 5,815,949

[45] Date of Patent: Oct. 6, 1998

[54] FOOTWEAR INSERT PROVIDING AIR CIRCULATION

[76] Inventor: Raymond V. Sessa, 5123 S. Quail Crest Dr., SE., Grand Rapids, Mich. 49546

[21] Appl. No.: 872,453

[22] Filed: Jun. 10, 1997

[51] Int. Cl.[6] ..... A43B 23/07

[52] U.S. Cl. ..... 36/3 B; 36/28; 36/29

[58] Field of Search ..... 36/3 R, 3 B, 28, 36/29, 71, 30 A, 31

[56] References Cited

U.S. PATENT DOCUMENTS

| | | |
|---|---|---|
| D. 190,162 | 4/1961 | Hubbard . |
| D. 311,989 | 11/1990 | Parker et al. . |
| 455,847 | 7/1891 | Howard et al. . |
| 945,698 | 1/1910 | Conway . |
| 1,165,847 | 12/1915 | Cashman . |
| 1,559,532 | 10/1925 | Smith . |
| 1,981,300 | 11/1934 | Berg . |
| 2,090,881 | 8/1937 | Wilson . |
| 2,302,706 | 11/1942 | Margolin . |
| 2,329,209 | 9/1943 | Manson et al. . |
| 2,358,342 | 9/1944 | Margolin . |
| 2,437,065 | 3/1948 | Austin . |
| 2,527,414 | 10/1950 | Hallgren . |
| 2,552,711 | 5/1951 | Dunker . |
| 2,710,461 | 6/1955 | Hack . |
| 2,833,057 | 5/1958 | Hack . |
| 2,930,149 | 3/1960 | Hack et al. . |
| 2,937,462 | 5/1960 | Hack et al. . |
| 2,941,316 | 6/1960 | Hack . |
| 2,941,317 | 6/1960 | Hack . |
| 2,963,800 | 12/1960 | Hack . |
| 2,994,326 | 8/1961 | Hack . |
| 3,005,272 | 10/1961 | Shelare et al. . |
| 3,006,085 | 10/1961 | Bingham . |
| 3,012,342 | 12/1961 | Ramirez . |
| 3,079,707 | 3/1963 | Hack et al. . |
| 3,079,708 | 3/1963 | Hack et al. . |
| 3,172,217 | 3/1965 | Colman . |
| 3,280,484 | 10/1966 | Sensi . |
| 3,299,544 | 1/1967 | Hack . |
| 3,426,455 | 2/1969 | Drago . |
| 3,444,632 | 5/1969 | Hack et al. . |

(List continued on next page.)

FOREIGN PATENT DOCUMENTS

| | | |
|---|---|---|
| 701087 | 1/1965 | Canada . |
| 2095272 | 11/1993 | Canada . |
| 1334128 | 1/1995 | Canada . |
| 388661 | 9/1990 | European Pat. Off. . |
| 1264637 | of 1962 | France . |
| 1302331 | 7/1962 | France . |
| 2626746 | of 1989 | France . |
| 3507295 | 9/1986 | Germany . |
| 137555 | 10/1952 | Sweden . |
| 499470 | 1/1939 | United Kingdom . |
| 1444091 | 7/1976 | United Kingdom . |
| 2152797 | 8/1985 | United Kingdom . |
| 8102969 | 10/1981 | WIPO . |
| 3003639 | 3/1993 | WIPO . |

OTHER PUBLICATIONS

WO 81/02969 Oct. 1981 PCT Gustavsen et al 36/29.
Dick Sullivan, "Rugged Clear shoe line shell–through going strong", *Footwear News,* vol. 51, No. 6, Feb. 6, 1995, p. 44.
Photograph of AVIA shoe.
Photograph of Reebok shoe.
Photograph of Cons. shoe.

*Primary Examiner*—M. D. Patterson
*Attorney, Agent, or Firm*—Warner Norcross & Judd

[57] ABSTRACT

A footwear sole insert with a plurality of downwardly extending pumping channels. The pumping channels extend transversely across the insert and include opposite longitudinal edges that simultaneously undulate toward and away from each other to provide the channels with alternating wide and narrow portions. The channels are positioned such that the narrow portions of one channel are generally aligned with the wide portions of the adjacent channels, and vice versa. Also, adjacent channels are separated from each other by an undulating, tapered recess that is narrowest at the bottom surface of the insert.

13 Claims, 6 Drawing Sheets

U.S. PATENT DOCUMENTS

| | | | |
|---|---|---|---|
| 3,507,059 | 4/1970 | Vietas . | |
| 3,624,930 | 12/1971 | Johnson et al. | 36/3 B |
| 3,717,943 | 2/1973 | Orndorff . | |
| 3,785,069 | 1/1974 | Brown . | |
| 3,834,046 | 9/1974 | Fowler . | |
| 4,071,963 | 2/1978 | Fukuoka . | |
| 4,120,102 | 10/1978 | Kenigson . | |
| 4,187,620 | 2/1980 | Selner . | |
| 4,215,492 | 8/1980 | Sandmeier . | |
| 4,222,185 | 9/1980 | Giaccaglia . | |
| 4,223,455 | 9/1980 | Vermeulen . | |
| 4,319,412 | 3/1982 | Muller et al. . | |
| 4,347,673 | 9/1982 | Svetlik | 36/30 R |
| 4,616,431 | 10/1986 | Dassler . | |
| 4,619,055 | 10/1986 | Davidson | 36/3 B |
| 4,712,314 | 12/1987 | Sigoloff . | |
| 4,776,109 | 10/1988 | Sacre . | |
| 4,817,304 | 4/1989 | Parker et al. . | |
| 4,845,863 | 7/1989 | Yung-Mao . | |
| 4,910,882 | 3/1990 | Goller | 36/3 B |
| 4,974,345 | 12/1990 | Yung-Mao . | |
| 5,199,191 | 4/1993 | Moumdjian . | |
| 5,235,761 | 8/1993 | Chang . | |
| 5,255,451 | 10/1993 | Tone et al. . | |
| 5,400,526 | 3/1995 | Sessa | 36/3 B |
| 5,402,588 | 4/1995 | Graham et al. . | |
| 5,493,791 | 2/1996 | Kramer . | |
| 5,542,195 | 8/1996 | Sessa . | |
| 5,619,809 | 4/1997 | Sessa . | |

FOOTWEAR INSERT PROVIDING AIR CIRCULATION

BACKGROUND OF THE INVENTION

The present invention relates to footwear, and more particularly to an insert for a footwear sole assembly.

In an effort to provide a blend of comfort and durability, manufacturers have developed a variety of sole constructions which include a cushioning insert sandwiched between an insole and a durable outsole. The outsole forms the wear surface of the shoe and is manufactured from a wear resistant material that provides the sole with a long life. The cushioning insert is protected from wear by the outsole and is manufactured from a resilient material that provides the sole construction with the desired cushioning. Some sole constructions also include a transparent window in the outsole which permits viewing of the cushioning inserts within the sole. These windows permit viewing of the design aspects of the insert and allow the consumer to see the technology.

While these previous constructions provide a balance of cushioning, durability and visual aesthetics, they do not address the comfort related issues associated with the fact that air is trapped within the upper around the wearer's foot. One method for addressing these issue is to provide a system for circulating air around the foot. Air circulation systems prevent stagnant air from being trapped around the foot where it can retain heat and moisture which not only make the footwear uncomfortable, but also provide a breeding-ground for bacteria.

A conventional air circulation system includes a bladder or similar pumping device contained within the sole assembly. As the wearer steps down on the footwear, the bladder or pumping device is compressed forcing air contained therein to circulate over the foot through openings in the insole. When the wearer's weight is lifted from the footwear, the bladder or pumping device expands to refill with air. The process repeats itself with every stride.

While conventional air circulation systems often provide adequate air circulation, they generally fail to provide the desired balance between resiliency, flexibility, durability, visual aesthetics, and cost.

SUMMARY OF THE INVENTION

The aforementioned problems are overcome by the present invention wherein a footwear sole is provided with an insert having transversely extending, downwardly opening, concave pumping channels. During walking, the channels are compressed causing the air trapped therein to flow around the wearer's foot through air holes defined through the insert. The pumping channels include a pair of opposed edges extending transversely across the sole. The paired edges simultaneously undulate toward each other and then away from each other to provide each channel with alternating wide and narrow portions. In addition, the depth of the channel varies across the insert to provide the channel with alternating deep and shallow portions. Preferably, the narrow portions correspond with the deep portions and the wide portions correspond with the shallow portions.

Adjacent pumping channels are spaced apart from one another by an undulating gap that follows the profile of the channel walls. The gap is preferably tapered so that it is widest at its base and narrowest at the bottom surface of the insert. Also, adjacent channels are positioned such that the narrow portions of one channel are generally aligned with the wide portions of the other channel.

The present invention provides a relatively low cost insert incorporating air circulation features. The undulating configuration of the pumping channels provides improved air distribution. Further, because adjacent channels are spaced apart from one another by a gap, the flexibility of the insert is improved. Additionally, the gap is tapered to provide the pumping channels with a wide footprint while maintaining the overall flexibility of the insert. The inserts are also visually pleasing and therefore are well suited for the consumer to see the technology. The concave pumping channels provide extra cushioning when depressed by body weight at both the heel and forepart.

These and other objects, advantages, and features of the invention will be readily understood and appreciated by reference to the detailed description of the preferred embodiment and the drawings.

DETAILED DESCRIPTION OF THE PREFERRED EMBODIMENT

Figure 1:
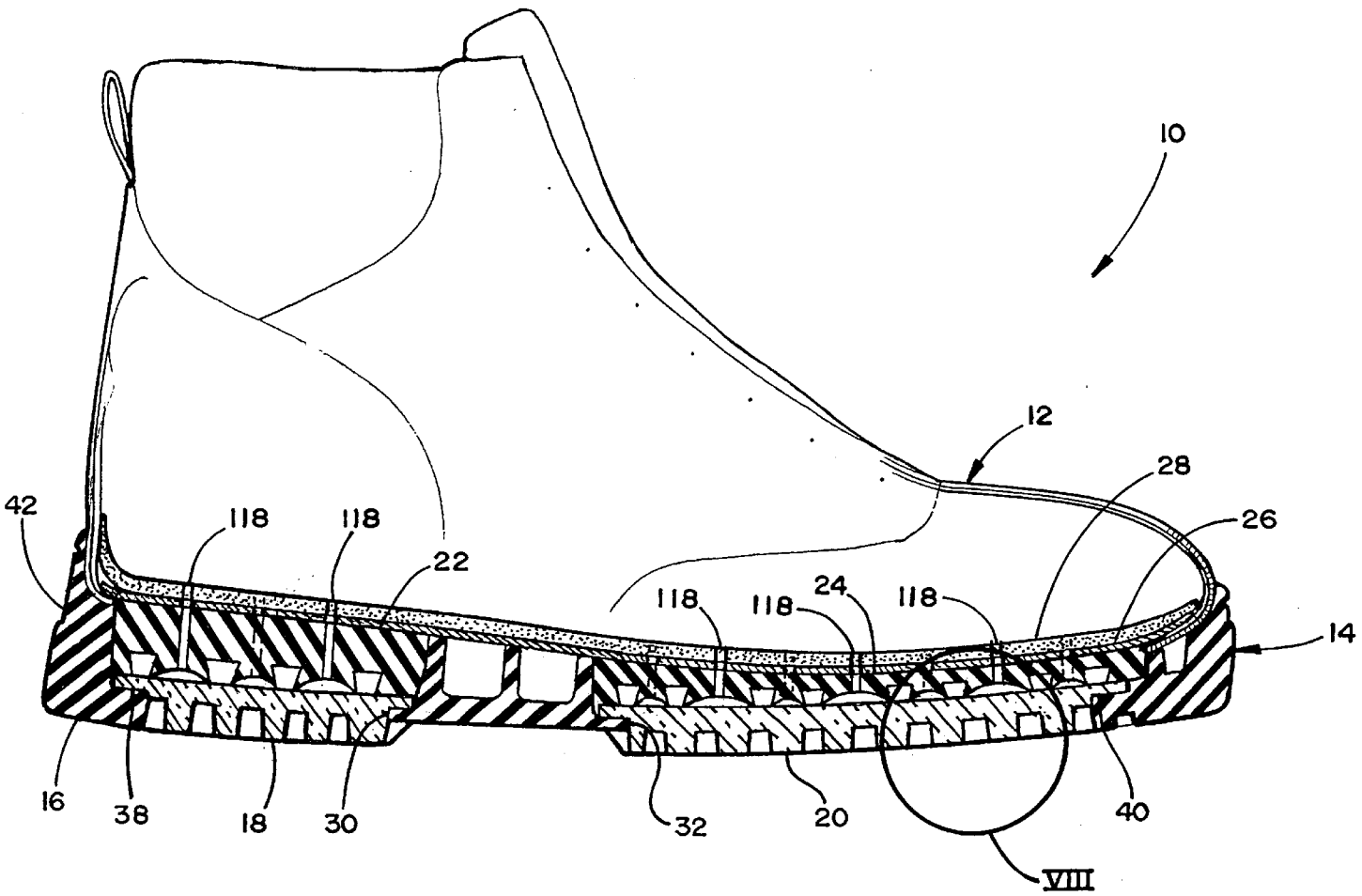
FIG. 1 a sectional side elevational view of a boot incorporating the inserts of the present invention.

A boot having a pair of inserts according to a preferred embodiment of the present invention is illustrated in FIG. 1, and generally designated 10. For purposes of this disclosure, the inserts will be described in connection with a conventional mid-height boot having an outsole assembly with a pair of transparent windows in the outsole which permits viewing of the inserts within the sole. The invention is equally well suited for use in other types of soled footwear. The described boot 10 includes a pair of inserts 22 and 24, one positioned in the forward or ball portion of the sole and another positioned in the rearward or heel portion of the sole. The present invention can be manufactured in virtually any number of parts. For example, the present invention could include a single insert adapted to extend the length of the sole or three separate insert parts adapted to fit in three separate portions of the sole.

The boot 10 includes an upper 12 and a sole assembly 14. The upper 12 is generally conventional and is manufactured from conventional materials using conventional techniques and apparatus. The upper 12 is secured to the sole assembly 14 using conventional techniques and apparatus. In the described embodiment, the upper 12 is secured to the outsole assembly 14 using a conventional welt construction.

The sole assembly 14 generally includes an outsole body 16, a pair of transparent windows 18 and 20 fitted within openings in the outsole body 16, a pair of inserts 22 and 24 located above the windows 18 and 20, an insole 26 positioned above the inserts 22 and 24, and an orthotic 28 positioned above the insole 26 (See FIG. 1).

Figure 2:
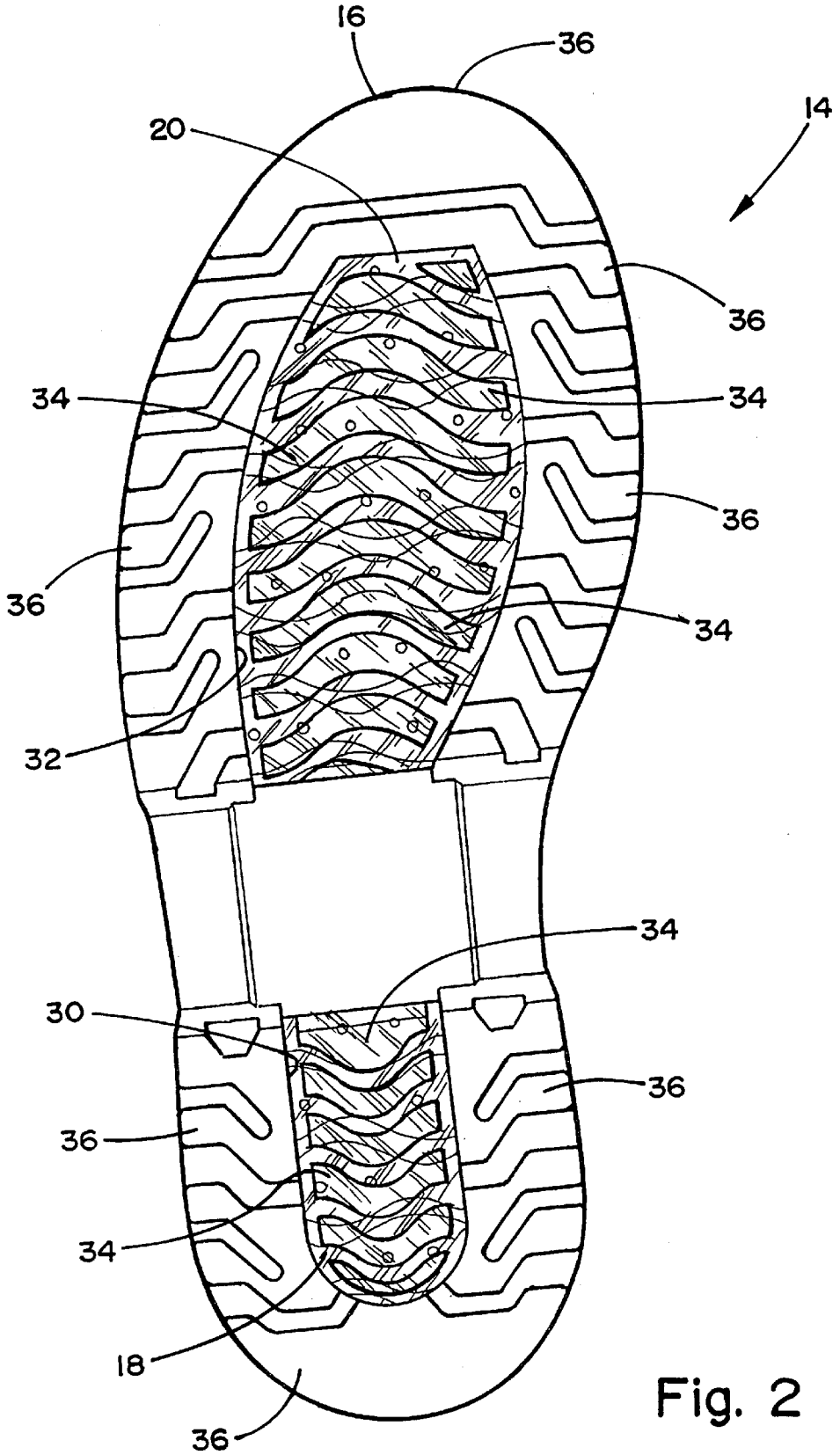
FIG. 2 is a bottom plan view of the sole assembly of the boot.
Figure 3:
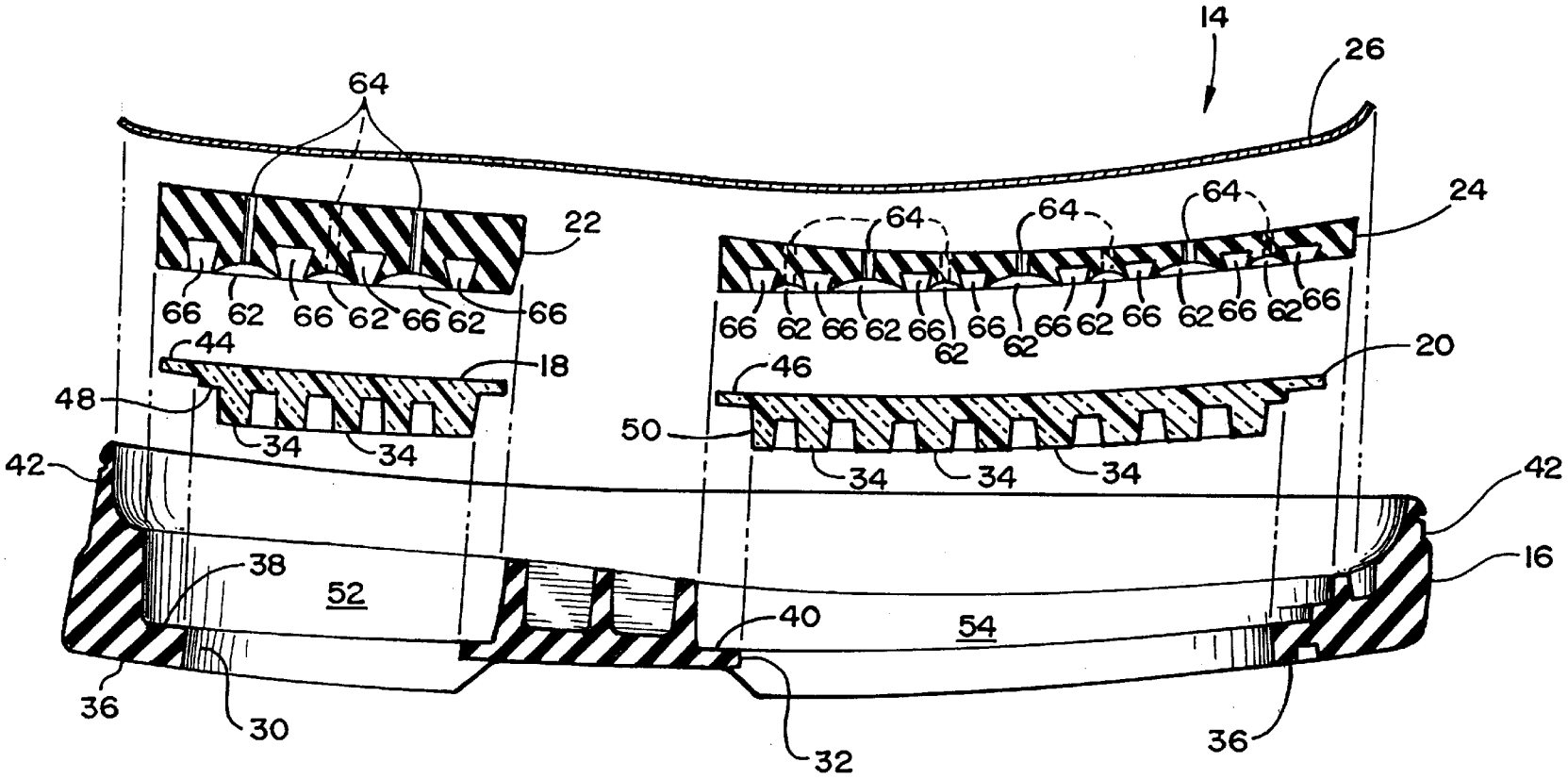
FIG. 3 is an exploded sectional view of the sole assembly.

The outsole body 16 in manufacture from a durable, wear-resistant material, such as polyurethane, and includes a plurality of downwardly extending cleats 36 configured to present the desired tread pattern (See FIG. 2). The bottom surface of each outsole body cleat 36 is preferably textured to provide a non-slip surface. The outsole body 16 defines a heel recess 52 in a rearward or heel portion of the sole assembly 14 and a ball recess 54 in a forward or ball portion of the sole assembly 14. During assembly, the windows 18 and 20 and heel and ball inserts 22 and 24 are fitted into these recesses. The sole body 16 also defines a heel opening 30 through the base of the heel recess 52 and a ball opening 32 through the base of the ball recess 54. The base of each recess 52 and 54 defines a generally flat shoulder 38 and 40 surrounding each opening 30 and 32, respectively. These shoulders 38 and 40 function as mounting surfaces for the windows 18 and 20, respectively. The outsole body 16 further includes a welt portion 42 extending upwardly around its periphery. The welt portion 42 is stitched or otherwise secured to the upper 12 to intersecure the two components. If desired, the welt portion 42 may be replaced by a conventional separate welt.

Figure 5:
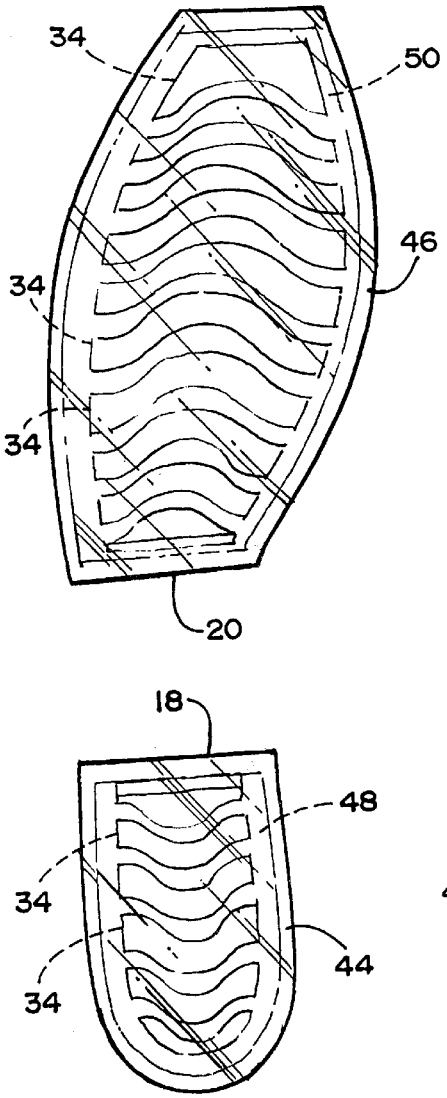
FIG. 5 is a top plan view of the sole assembly windows.
Figure 4:
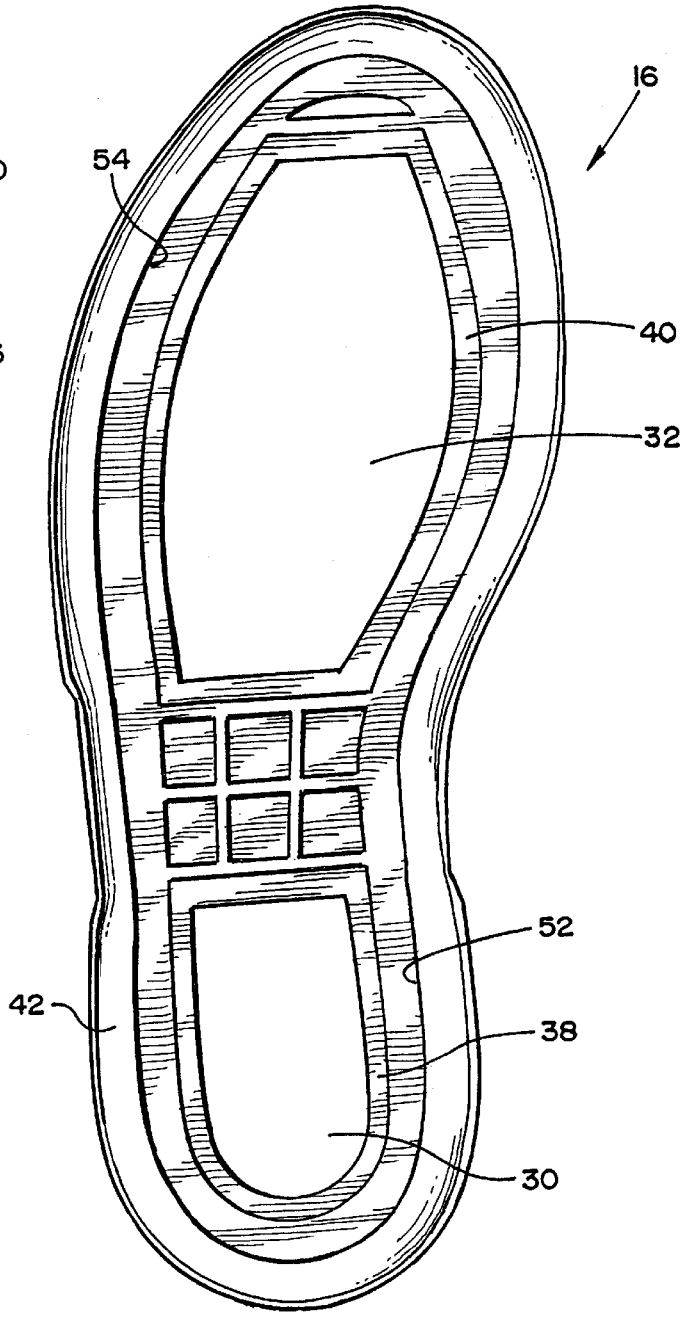
FIG. 4 is a top plan view of the outsole body.

The windows 18 and 20 are manufactured from a wear resistant material that is either transparent or translucent, such as polyvinyl chloride. The windows 18 and 20 are fitted within the bottom of the heel and ball recesses 52 and 54 in the outsole body 16. Each window 18 and 20 includes a marginal portion 44 and 46, respectively, extending around its periphery. These marginal portions 44 and 46 are cemented or otherwise attached to the shoulders 38 and 40 to intersecure the windows 18 and 20 and the outsole body 16. Each window 18 and 20 also includes a cleat base 48 and 50, respectively, and a plurality of downwardly extending cleats 34 that extend through openings 30 and 32, respectively. The cleats 34 undulate transversely across the windows 18 and 20 (See FIGS. 2 and 5). The cleats 34 of the heel window 18 curve rearwardly toward the center of the boot 10 and the cleats 34 of the ball window 20 curve forwardly toward the center of the boot 10. The bottom surface of each window cleat 34 is preferably textured to provide a non-slip surface. The window cleats 34 cooperate with the outsole body cleats 36 to define the wear surface of the boot 10. The style and configuration of the window cleats 34 and outsole body cleats 36 may vary from application to application.

The inserts 22 and 24 are manufactured from closed cell polyurethane or other sufficiently resilient materials and are fitted within the heel and ball recesses 52 and 54 of the outsole body 16. The inserts 22 and 24 rest upon and are visible through the windows 18 and 20. The heel insert 22 is fitted within heel opening 52 and includes a body portion 60 and a plurality of downwardly depending pumping channels 62. As perhaps best shown in FIG. 8, the bottom surface of each pumping channel 62 is concave so that an air chamber 76 is defined between the pumping channel 62 and the top surface of the window 18. A plurality of air passages 64 are defined through the heel insert 22 in communication with the pumping channels 62. These passages 64 permit air to be expelled from the air chamber 76 when the heel insert 22 is compressed. The pumping channels 62 extend transversely across the undersurface of the body portion 60 and each includes a pair of longitudinal edges 68 and 70 that simultaneously undulate toward and away from each other to provide the channel 62 with alternating wide and narrow portions 72 and 74, respectively. In addition, the depth of each channel 62 varies across the insert to provide the channel 62 with alternating deep and shallow portions 100 and 102, respectively. The undulations are arranged so that the shallow portions 102 and the narrows portions 74 correspond and the deep portions 100 and wide portions 72 correspond. The front and rear end portions 110 and 112 of the heel insert 22 do not include a convex bottom surface. Rather, these portions are solid to provide peripheral support for the insert 22.

Figure 6:
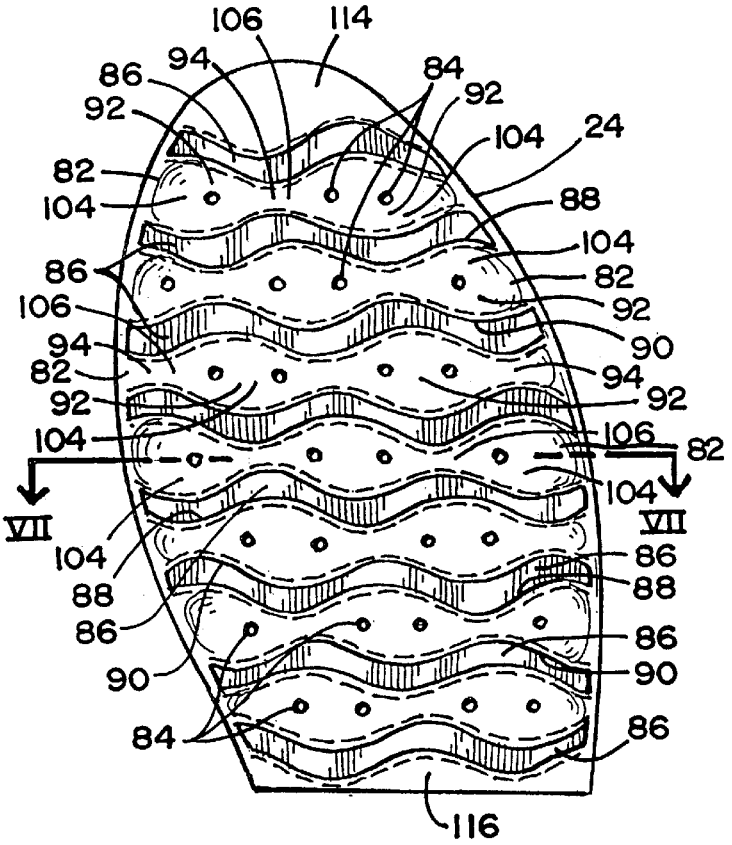
FIG. 6 is a bottom plan view of the inserts.
Figure 6:
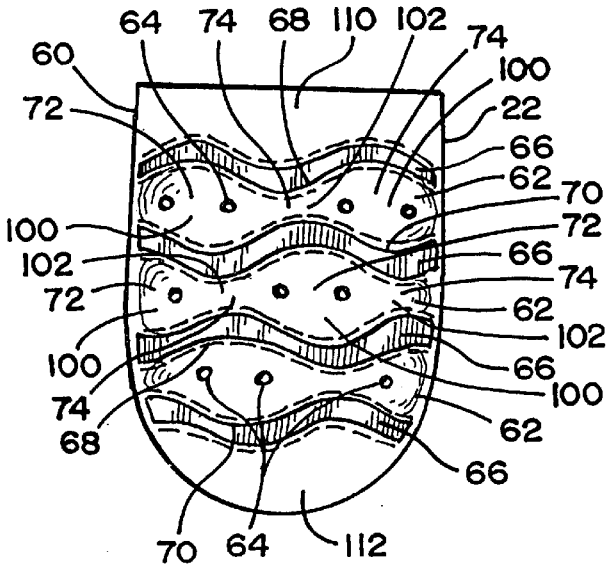
Figure 7:
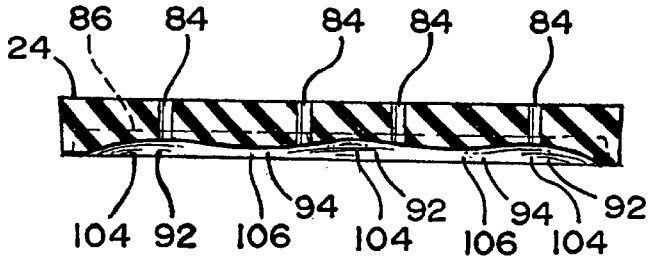
FIG. 7 is a sectional view of heel insert taken along line VII—VII of FIG. 6.

As perhaps best shown in FIG. 6, the pumping channels 62 are positioned such that the narrow portions 74 of one channel are generally aligned with the wide portions 72 of the adjacent channels, and vice versa. Adjacent pumping channels are spaced apart from one another by an undulating recess 66 that extends transversely across the insert 22. The recess 66 is tapered such that it is narrowest at the bottom surface of the insert 22 and widest at its base (adjacent to the body portion 60). Accordingly, opposite longitudinal edges 68 and 70 of each pumping channel 62 flare outwardly away from each other as they extend downwardly from the body portion 60. This allows the channels 62 to deform more readily under compression forces, and provides the pumping channels 62 with a large footprint while giving the insert 22 improved flexibility.

The ball insert 24 is fitted within ball opening 54 and includes a body portion 80 and a plurality of downwardly depending pumping channels 82. Like those of the heel insert 22, the pumping channels 82 of the ball insert 24 extend transversely across the undersurface of the body portion 80. Each pumping channel 82 includes a pair of longitudinal edges 88 and 90 that simultaneously undulate toward and away from each other to provide the channel 82 with alternating wide and narrow portions 92 and 94, respectively. The bottom surface of each pumping channel 82 is concave so that an air chamber 96 is defined between the pumping channel 82 and the window 20 (See FIG. 8). As with the heel insert 22, each channel 82 in the ball insert 24 varies in depth across the insert 24 to provide the channel 82 with alternating deep and shallow portion 104 and 106, respectively. The undulations are arranged so that the shallow portions 106 and the narrow portions 94 correspond and the deep portions 104 and wide portions 92 correspond. A plurality of air passages 84 are defined through the ball insert 24 in communication with the pumping channels 82 to permit air to be expelled from the air chamber 96 when the ball insert 24 is compressed. The bottom surfaces of the front and rear end portions 114 and 116 of the ball insert 24 are not convex. Instead, these portions are solid to provide peripheral support for the ball insert 24.

Like the heel insert 22, the pumping channels 82 in the ball insert 24 are positioned such that the narrow portions 94 of one channel are generally aligned with the wide portions 92 of the adjacent channels, and vice versa. Also, adjacent pumping channels are spaced apart from one another by an undulating recess 86 that extends transversely across the insert 24. The recesses 86 of the ball insert 24 are tapered in the same manner as the recesses 66 of the heel insert 22.

As noted above, the sole assembly 14 also includes an insole 26 and an orthotic 28. These components are generally conventional, however, each defines a plurality of air passages 118 that are aligned with the air passages 64 and 84 in the heel and ball inserts. These passages 118 permit air expelled from the air chambers 76 and 96 to flow up through the insole 26 and orthotic 28 around the wearer's foot. The insole 26 is typically secured to the upper 12 in a conventional. If desired, the orthotic 28 can be cemented or otherwise secured directly to the insole 26 to retain alignment of the air passages.

Figure 8:
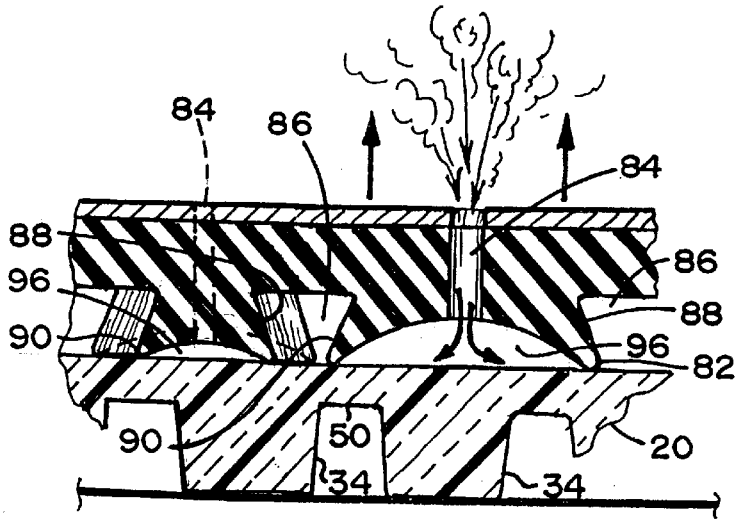
FIG. 8 is an enlarged view of area VIII of in FIG. 1.
Figure 9:
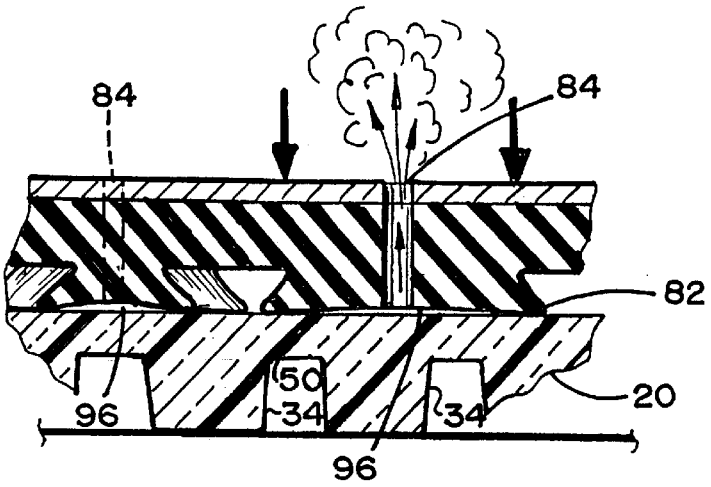
FIG. 9 is an enlarged view of a portion of the sole assembly similar to FIG. 8 showing the pumping channel compressed under force.

In use, the unique inserts 22 and 24 of the present invention generate air circulation within the boot 10 while providing excellent cushioning and flexibility characteristics. As shown in FIG. 1, the heel and ball inserts 22 and 24, respectively, are positioned directly above the heel and ball windows 18 and 20, respectively. The pumping channels 62 and 82 directly engage the top surface of the windows 18 and 20, respectively. Due to the concave shape of the pumping channels, an air chamber 76 and 96 is defined beneath each pumping channel 62 and 82, respectively. FIG. 8 is an enlarged sectional view of a portion of the ball insert 24 showing the insert 24 without a load applied. FIG. 9 is a similar view of the ball insert 24 showing the insert 24 compressed under a load. In the relaxed state shown in FIG. 8, the volume of the air chamber 96 is relatively large. As a load is applied (e.g. a wearer steps down on the sole), the edges 88 and 90 of the pumping channel 82 are compressed and otherwise deformed such that the air chamber 96 begins to collapse. This decreases the volume of the air chamber 96 forcing the air within the chamber 96 to vent through the air passages in the insert 24, the insole 26, and the orthotic 28. This air then flows around the wearer's foot. Initially, the air chamber 96 is a single chamber extending entirely across the insert 24. This permits air pressure to equalize through the air chamber 96. However, as the insert 24 continues to compress, the shallow portions 106 of each channel 82 eventually engage the top surface of the window 20, thereby dividing the air chamber 96 into separate subchambers. As the insert 24 is further compressed, these chambers separately compress to separately circulate air throughout the boot. When the load is removed (e.g. the wearer lifts his foot), the insert 24, by virtue of its resiliency, returns its relaxed shape. As it returns to its relaxed shape, the air chamber 96 expands drawing in air from around the wearer's foot through the air passages in the orthotic 28, insole 26, and insert 24.

The above description is that of a preferred embodiment of the invention. Various alterations and changes can be made without departing from the spirit and broader aspects of the invention as defined in the appended claims, which are to be interpreted in accordance with the principles of patent law including the doctrine of equivalents.

The embodiments of the invention in which an exclusive property or privilege is claimed are defined as follows:

1. A footwear sole assembly comprising:

an outsole defining a recess; and an insert fitted within said recess, said insert including a plurality of transversely extending pumping channels, said channels having a concave bottom surface and opposed longitudinal edges that undulate across said insert, said edges simultaneously undulating toward and away from each other to define alternating narrow portions and wide portions, said insert defining air passages extending from said pumping channels to permit air to vent from said pumping channels when said insert is compressed, said insert defining a recess separating adjacent pumping channels.

2. The assembly of claim 1 wherein said concave bottom surface defines an air chamber, said air chamber varying in depth across said insert to define alternating shallow portions and deep portions.

3. The assembly of claim 2 wherein said shallow portions correspond with said narrow portions and said deep portions correspond with said wide portions.

4. The assembly of claim 3 wherein adjacent pumping channels are positioned such that said narrow portions of one channel are generally aligned with said wide portions of the other pumping channel.

5. A insert for a sole assembly comprising:

a body portion; and a plurality of pumping channels extending downwardly from said body portion, said channels extending transversely across said body portion and having a concave bottom surface, said channels each including opposed longitudinal edges that undulate across said body portion, adjacent channels spaced apart from another to define an undulating recess extending transversely across the insert, said recess including a base and an open end, said recess being tapered such that its width is greater at said base then at said open end, said edges simultaneously undulating toward and away from each other to define alternating narrow portions and wide portions, said body portion defining air passages extending from said pumping channels to permit air to vent from said pumping channels when said insert is compressed.

6. The insert of claim 5 wherein said concave bottom surface defines an air chamber, said air chamber varying in depth across the insert to define alternating shallow portions and deep portions.

7. The insert of claim 6 wherein said shallow portions correspond with said narrow portions and said deep portions correspond with said wide portions.

8. The insert of claim 7 wherein adjacent pumping channels are positioned such that said narrow portions of one channel are generally aligned with said wide portions of the other pumping channel.

9. The insert of claim 8 further comprising front and rear end portions protruding downwardly from said body portion, said end portions each having a substantially planar bottom surface.

10. A sole assembly comprising:

an outsole body defining first and second insert recesses;

a first insert fitted within said first recess; and a second insert fitted within said second recess, wherein said inserts each include a body portion and a plurality of downwardly extending pumping channels, said channels extending transversely across said inserts and each including opposed longitudinal edges that simultaneously undulate toward and away from each other to define alternating narrow and wide portions, said pumping channels disposed such that said narrow portions of one channel are generally aligned with said wide portions of an adjacent channel, said channels spaced apart from one another to define a recess between adjacent channels, said recess undulating across said insert in correspondence with the undulations of said edges, said pumping channels each including a concave bottom surface.

11. The assembly of claim 10 wherein said concave bottom surface defines an air chamber, said air chamber varying in depth across the insert to define alternating shallow portions and deep portions.

12. The assembly of claim 11 wherein said shallow portions correspond with said narrow portions and said deep portions correspond with said wide portions.

13. The assembly of claim 12 wherein said inserts each include front and rear end portions protruding downwardly from said body portion, said end portions each having a substantially planar bottom surface to provide said inserts with peripheral support.

* * * * *